US006005957A

United States Patent [19]

Meeks

[11] Patent Number: 6,005,957

[45] Date of Patent: Dec. 21, 1999

[54] LOUDSPEAKER PRESSURE PLATE

[75] Inventor: Timothy E. Meeks, Belcamp, Md.

[73] Assignee: Tenneco Automotive Inc., Lake Forest, Ill.

[21] Appl. No.: 09/032,317

[22] Filed: Feb. 27, 1998

[51] Int. Cl.[6] ..... H04R 25/00

[52] U.S. Cl. ..... 381/386; 381/71.5; 381/71.7; 381/395; 181/171; 181/206

[58] Field of Search ..... 381/3.2, 71.4, 381/71.5, 71.7, 86, 87, 332, 386, 389, 395, 397; 181/266, 148, 150, 171, 172, 198, 199, 204, 205, 224, 228, 229; 248/614, 901, 903

[56] References Cited

U.S. PATENT DOCUMENTS

| | | | |
|---|---|---|---|
| 4,034,165 | 7/1977 | Haeder | 381/397 |
| 4,138,593 | 2/1979 | Hasselbach et al. | 381/397 |
| 4,550,229 | 10/1985 | Hwang | 381/386 |
| 4,565,905 | 1/1986 | Nation | 381/386 |
| 4,847,907 | 7/1989 | Ando . | |
| 5,229,556 | 7/1993 | Geddes | 381/71.7 |
| 5,287,412 | 2/1994 | Etzel et al. . | |
| 5,336,856 | 8/1994 | Krider et al. | 181/206 |
| 5,541,373 | 7/1996 | Cheng | 381/71.7 |
| 5,550,334 | 8/1996 | Langley | 381/71.7 |
| 5,627,904 | 5/1997 | Yang et al. . | |
| 5,693,918 | 12/1997 | Bremigan et al. | 381/71.7 |
| 5,699,438 | 12/1997 | Smith et al. | 381/386 |
| 5,748,749 | 5/1998 | Miller et al. | 381/71.7 |
| 5,828,759 | 10/1998 | Everingham | 381/71.5 |
| 5,848,168 | 12/1998 | Shipps et al. | 38/71.1 |

*Primary Examiner*—Forester W. Isen
*Assistant Examiner*—Xu Mei
*Attorney, Agent, or Firm*—Harness, Dickey & Pierce, P.L.C.

[57] ABSTRACT

An apparatus for mounting a loudspeaker within an enclosure is disclosed. The apparatus includes a loudspeaker mounting plate formed within the enclosure, and a mounting boss formed within the enclosure which is separated from the loudspeaker mounting plate by a fixed distance. The loudspeaker includes a first surface for engaging the loudspeaker mounting plate and a second surface disposed opposite the first surface. A pressure plate is disposed between the second surface of the loudspeaker and the mounting boss. An axial force member is associated with the pressure plate, and the axial force member is operable for applying a force between the pressure plate and the mounting boss for securing the loudspeaker between the loudspeaker mounting plate and the mounting boss.

33 Claims, 4 Drawing Sheets

LOUDSPEAKER PRESSURE PLATE

BACKGROUND OF THE INVENTION

1. Technical Field

The present invention generally relates to an enclosure and mounting apparatus for an acoustic signal generating device. More particularly, the present invention relates to a pressure plate for mounting a loudspeaker within an enclosure for use with an active noise cancellation muffler system.

2. Discussion

The application of active noise cancellation (ANC) technology to eliminate various noise signals is generally known within the art. ANC technology is currently used in a variety of applications including controlling noise produced by industrial blowers, lowering the noise levels within cabins of aircraft, and significantly reducing the noise levels emitted from exhaust systems of combustion engines. These systems typically operate by creating an anti-noise signal which is equal in amplitude and opposite in phase with the primary noise signal. In theory, when the primary noise signal and the anti-noise signal are acoustically combined, the two signals effectively cancel one another which significantly reduces the production of any sound. The ANC muffler systems used with combustion engine exhaust systems are typically either built around the primary exhaust conduit, or are placed adjacent to the primary exhaust conduit. The primary or exhaust noise signal and anti-noise signal are then combined for cancelling the production of sound.

In many ANC muffler systems, a loudspeaker is housed in an enclosure which increases its efficiency, tunes its response range, and protects it from the elements within its operating environment. A variety of enclosure designs have been implemented over the years, two of which are a second order enclosure and a fourth order enclosure. The second order enclosure can take on several shapes, but in its simplest form, is a housing with a loudspeaker mounted inside on an open face. The dimensions and volume of the box or enclosure work in conjunction with the loudspeaker characteristics to determine the output of the system. Although the second order enclosure is perhaps the most common type, it is not well suited for protecting the loudspeaker due to its open face.

Alternatively, a fourth order enclosure is better suited for applications in which the loudspeaker must be protected. The fourth order enclosure is commonly called a bandpass enclosure because it is designed to have a large acoustic output over a narrow frequency range. The primary enclosure parameters which determine the operational frequency range and the amount of sound produced are the back volume, front volume, port area, and port length. By varying the values and ratios of these parameters, the sound level and bandwidth of the enclosure can be altered to meet the desired output requirements.

In view of these characteristics, the fourth order enclosure is generally preferred for ANC muffler applications for cancelling engine exhaust. The fourth order enclosure is particularly well suited for these applications because the partially enclosed front volume mechanically protects the loudspeaker cone from intruding objects and the outside elements. Furthermore, the fact that a fourth order enclosure system produces high sound energy in a small frequency band is ideal for low frequency engine exhaust tones.

The most widely utilized method for securing a loudspeaker within an enclosure is to use multiple fasteners, typically four to eight, around the loudspeaker flange. With fourth order enclosures, this mounting method is commonly facilitated by creating a back volume cover for enclosing the back of the loudspeaker and attaching to the front portion of the enclosure, thus creating a seal. This two-piece design is sometimes referred to as a "clam shell" design. However, this design has several drawbacks including an increased number of parts to manufacture, and difficulty in servicing once mounted under the vehicle body. Moreover, the prior designs require a large number of fasteners which in turn necessitates additional drilling and tapping processes which are expensive. Additional problems with mounting the speaker via the mounting flange are installing and removing the fasteners within a small enclosure area, and non-uniform loudspeaker gasket compression. More specifically, this configuration causes stress concentrations in that the loudspeaker gasket naturally compresses more around the screws and less in the area between the screws, thus creating a sealing problem.

An additional problem recognized within the art is thermal failure of the loudspeaker voice coil due to overheating. Often times, the requirements for a smaller enclosure require using a smaller loudspeaker which can sacrifice acoustic performance. To compensate for this loss in performance, the loudspeakers are driven at higher levels, often approaching or exceeding their upper limits. At higher input levels, the magnet and voice coil of the loudspeaker heats up and under extreme conditions can overheat and become damaged or destroyed. Accordingly, it is desirable to provide an enclosure and system for mounting the loudspeaker which provides heat sinking to remove excess heat from the loudspeaker magnet and voice coil.

One of the challenges presented to further development of ANC muffler systems is designing a suitable enclosure which is lightweight, efficient to assemble in a mass production environment, and which is unaffected by its operating environment including water, high levels of heat, and stones thrown under the vehicle. In view of the limitations associated with the prior art, it is desirable to provide an enclosure and mounting apparatus which provides a simple and cost efficient apparatus for mounting the loudspeaker within the enclosure. It is further desirable to provide an enclosure and mounting apparatus which allows the loudspeaker to be replaced by removing a minimal number of fasteners using simple hand operated tools. Finally, it is desirable to provide a mounting apparatus which also provides for the dissipation of heat generated by the loudspeaker during operation.

SUMMARY OF THE INVENTION

Pursuant to the present invention, a low cost enclosure and apparatus for mounting a loudspeaker within the enclosure is disclosed. The mounting apparatus and enclosure are suitable for use with an active noise cancellation muffler system. The apparatus includes a loudspeaker mounting plate formed within the enclosure, and a mounting boss formed within the enclosure which is separated from the loudspeaker mounting plate by a fixed distance. The loudspeaker includes a first surface for engaging the loudspeaker mounting plate and a second surface disposed opposite the first surface. A pressure plate is disposed between the second surface of the loudspeaker and the mounting boss. An axial force member is associated with the pressure plate, and the axial force member is operable for applying a force between the pressure plate and the mounting boss for securing the loudspeaker between the loudspeaker mounting plate and the mounting boss.

BRIEF DESCRIPTION OF THE DRAWINGS

Additional objects, advantages and features of the present invention will become apparent from the following description and appended claims, taken in conjunction with the accompanying drawings in which:

DETAILED DESCRIPTION OF THE PREFERRED EMBODIMENTS

Figure 1:
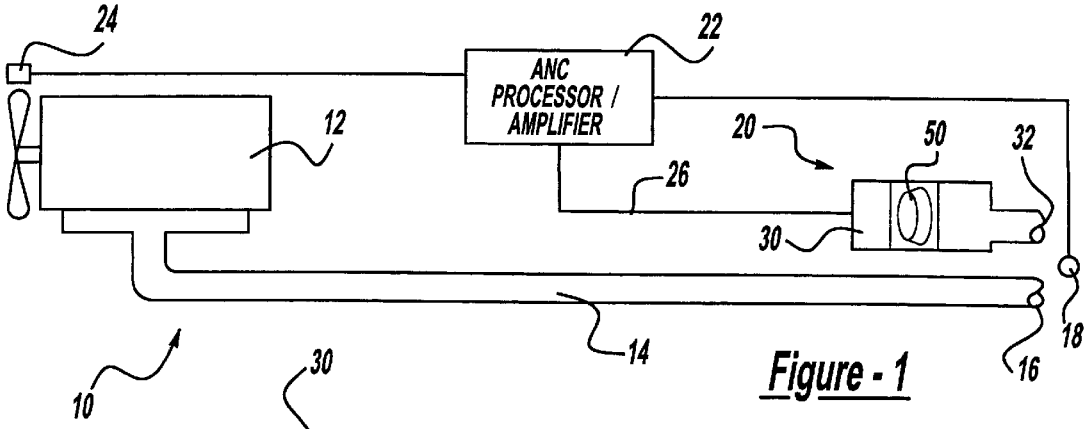
FIG. 1 is a schematic diagram of an active noise cancellation muffler system in accordance with the preferred embodiment of the present invention.

The following description of the preferred embodiments is merely exemplary in nature and is in no way intended to limit the invention, its applications or uses. Referring now to FIG. 1, an exemplary active noise cancellation (ANC) muffler system 10 is shown. More particularly, a combustion engine 12 produces a noise signal which travels along an exhaust conduit 14 and is emitted through an outlet 16. An active noise cancellation muffler 20 having an outlet 32 is placed generally adjacent the exhaust conduit 14 and preferably in the same plane as the outlet 16. The ANC muffler 20 is controlled by an ANC processor 22 which receives a feedback signal from a microphone 18 placed in the vicinity of the exhaust conduit outlet 16 and the muffler outlet 32, and a synchronization signal 24 produced by the combustion engine 12. The ANC processor 22 then generates an electronic noise cancellation signal on output 26 which is amplified and reproduced by an acoustic loudspeaker 50 contained within the ANC muffler enclosure 30. When the exhaust noise signal and the anti-noise signal produced by ANC muffler 20 are combined, the resulting noise is significantly reduced. It should also be understood that ANC processor, which also includes an amplifier for driving loudspeaker 50, and microphone 18 can be integrated within or supported on ANC muffler enclosure 30.

Figure 2:
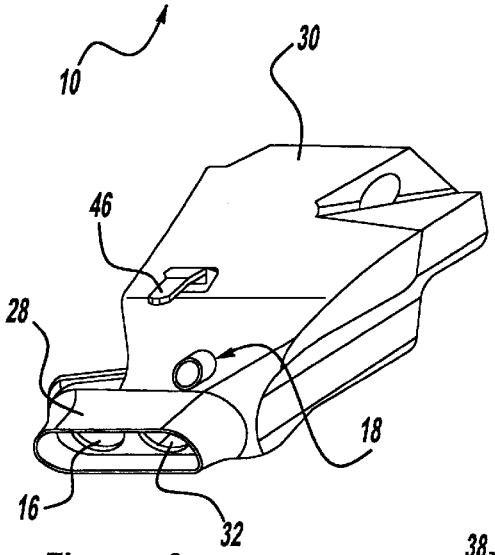
FIG. 2 is a front perspective view of an enclosure in accordance with one preferred embodiment of the present invention.
Figure 3:
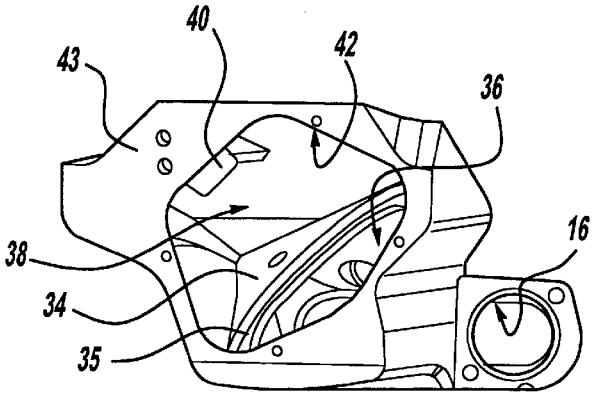
FIG. 3 is a rear elevational view of the enclosure shown in FIG. 2.
Figure 4:
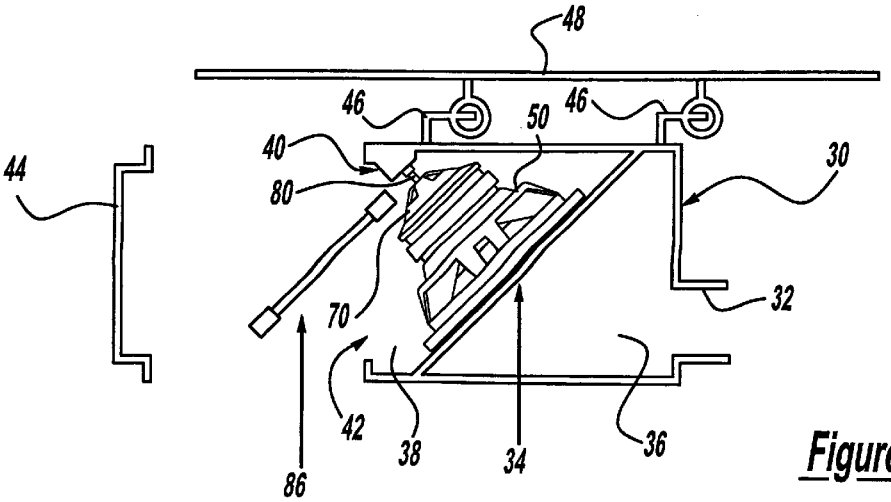
FIG. 4 is a partial sectional view of the enclosure in accordance with a preferred embodiment of the present invention.

Referring to FIGS. 2 through 4, the enclosure associated with a preferred embodiment of the invention is shown. More specifically, enclosure 30 includes an outlet 32 through which the anti-noise signal is emitted. As specifically shown in FIG. 2, outlet 32 is preferably placed along the same plane as exhaust outlet 16. A mixing chamber 28 may be optionally included for collocating enclosure outlet 32 and exhaust outlet 16. As best shown in FIG. 4, enclosure 30 includes a speaker mounting plate 34 defines a circular opening having an annular recess 35 formed thereabout. Speaker mounting plate 34 defines a front volume 36 and a back volume 38. Preferably, speaker mounting plate 34 is integrally formed within enclosure 30 for reducing the number of components for final assembly, as well as reducing the potential for unwanted vibrations. It is also preferable that enclosure 30 is cast in one piece from aluminum or magnesium for providing a lightweight yet structurally rigid enclosure. The back wall of enclosure 30 includes a mounting boss 40 which is also integrally formed as part of the casting. An opening 42 is provided at the rear of enclosure 30 which allows the loudspeaker 50 to be inserted within back volume 38. A rear mounting surface 43 allows an enclosure cover or cap 44 to be secured thereon with suitable fasteners. Enclosure 30 also includes a plurality of hangers 46 which allow the enclosure 30 to be suspended from the vehicle under carriage 48. As will be appreciated, enclosure 30 defines a fourth order bandpass enclosure for housing the loudspeaker 50, as well as protecting loudspeaker 50 from direct contact with the outside elements of the operating environment such as dirt, moisture, and stones thrown under the vehicle.

Turning now to FIGS. 5 through 9, the loudspeaker and mounting apparatus according to the teachings of the present invention are shown in more detail. The loudspeaker 50 associated with the present invention is a conventional acoustic speaker driven by a voice coil, with the appropriate modifications for use with ANC muffler 20. Loudspeaker 50 includes a rigid frame 52 which further defines a mounting flange 54. A gasket 56 is secured to mounting flange 54 which assists in creating a tight seal when engaged with recessed portion 35 of speaker mounting plate 34. A cone 58 is supported within frame 52 and is driven by the voice coil for producing acoustic sound waves. Loudspeaker 50 is driven by a magnet 60 and voice coil arrangement (not shown). The back of magnet 60 defines a back plate 62 having an optional bore or vent 64 formed therein.

As will be appreciated, frame 52 and flange 54 should be fairly stiff to withstand the pressure applied thereto by the mounting apparatus of the present invention. The compressible gasket 56 helps to provide an airtight seal between front volume 36 and back volume 38, and should be compressible enough to account for the potentially uneven surface of annular recess 35. Additionally, back plate 62 should be substantially parallel to mounting flange 54 so that consistent pressure can be applied about the circumference of gasket 56.

A thermally conductive pad 66 may optionally be included between back plate 62 and pressure plate 70. The purpose of the thermally conductive pad 66 is to increase the thermal conductivity between the pressure plate 70 and the loudspeaker magnet 60. While it should be understood that the thermally conductive pad 66 is not required, its function becomes more important when one or more of the mating surfaces is rough. Such rough or slightly uneven surfaces are frequently encountered when these parts are formed from sand castings, rather than by machining or milling processes. However when used, a compressible pad such as pad 66 will effectively increase the contact area between back plate 62 and pressure plate 70 thereby increasing the ability to transfer heat away from magnet 60 for cooling the voice coil. If loudspeaker 50 includes a bore or breather vent 64, thermally conductive pad 66 may also include a complimentary hole (not shown) in its center.

Figure 5:
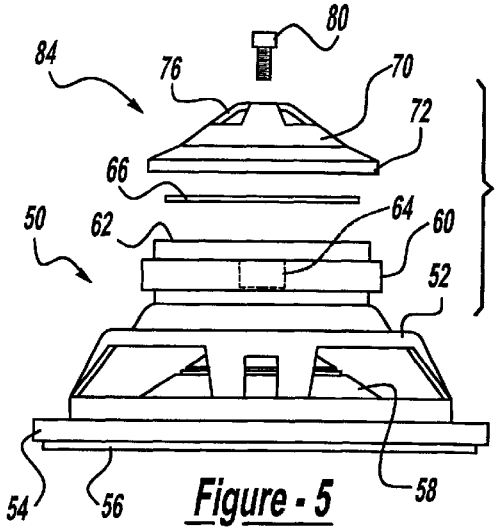
FIG. 5 is an exploded view of the loudspeaker and mounting apparatus according to a preferred embodiment of the present invention.
Figure 6:
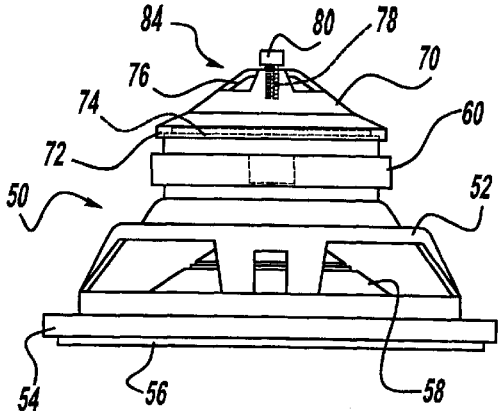
FIG. 6 is a side view of an assembled loudspeaker and mounting apparatus.
Figure 7:
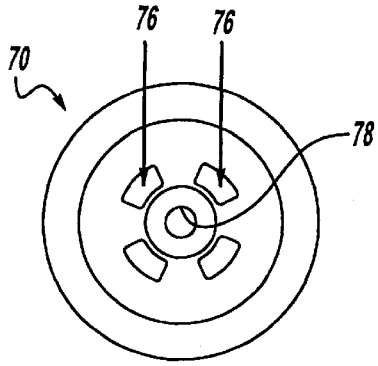
FIG. 7 is a top plan view of the pressure plate according to the teachings of the present invention.
Figure 8:
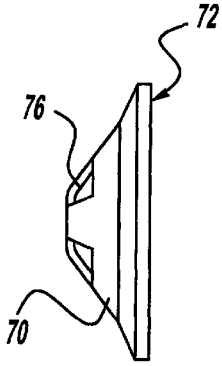
FIG. 8 is a side view of the pressure plate shown in FIG. 7.
Figure 9:
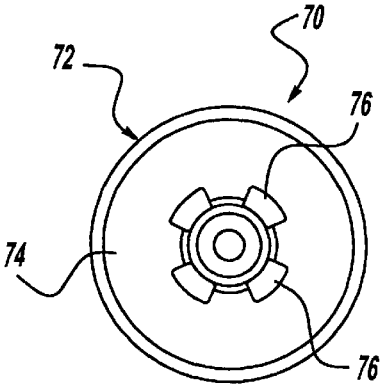
FIG. 9 is a bottom plan view of the pressure plate.

As more specifically shown in FIGS. 7 through 9, pressure plate 70 is preferably a conically-shaped metal member. The bottom of pressure plate 70 includes an annular lip 72 formed about its circumference which defines a circular recess 74. A plurality of vents 76 are formed through pressure plate 70. As shown, four such vents are provided. However, one skilled in the art will readily appreciate that the number of vents, as well as their specific shape can be custom designed for the particular application. The center of pressure plate 70 includes a threaded bore 78 for receiving an axial force member 80. As shown in FIGS. 5 and 6, the axial force member 80 is a threaded bolt having a hexagonal head, and bore 78 is appropriately threaded for receiving bolt 80. Alternatively, it should be appreciated that the axial force member 80 may be one of a variety of fastening or force exerting elements including, but not limited to, a threaded stud with a nut, a compressed coil spring, a spring pin, or a wedge block without deviating from the scope of the present invention. The loudspeaker 50, thermally conductive pad 66 (optional), pressure plate 70, and axial force member 80 are assembled in a stacked loudspeaker and mounting apparatus assembly 84 as most clearly shown in FIG. 6.

With continued reference to FIGS. 5 through 9, the pressure plate 70 is a mechanical member which distributes the concentrated force of the axial force member 80 to the entire loudspeaker back plate 62, and indirectly, to the loudspeaker flange 54 and gasket 56. Accordingly, the force from axial force member 80 is supported and opposed by speaker mounting plate 34 for securely retaining loudspeaker 50 within enclosure 30. The flat cone shape defining pressure plate 70 lends itself particularly well for this purpose. Vent holes 76 are needed if the loudspeaker 50 has a breather vent or bore 64 formed through the back of the magnet 60 to enhance the dissipation of heat from both magnet 60 and pressure plate 70. A particular feature of the present invention is the annular lip 72 formed around the bottom of pressure plate 70 which encircles or "captivates" the loudspeaker back plate 62 for easy centering during assembly within enclosure 30. Thus, as disclosed, the diameter of recess 74 is only slightly larger than the diameter of magnet 60 or back plate 62. The annular lip 72 as well as annular recess 35 also prevents loudspeaker from moving once secured within enclosure 30. It is preferable that pressure plate 70 is made from aluminum, or another suitable hard material with high thermal conductivity, thus providing a large heatsink for the loudspeaker magnet 60. Accordingly, this feature increases the ability of pressure plate 70 to drain undesirable heat from the magnet 60 and voice coil, and therefore decreases the likelihood of a thermal failure of loudspeaker 50. It is also preferable that pressure plate 70 is formed from a non-ferrous metal so that its contact with loudspeaker magnet 60 does not affect the operation of loudspeaker 50.

Figure 11:
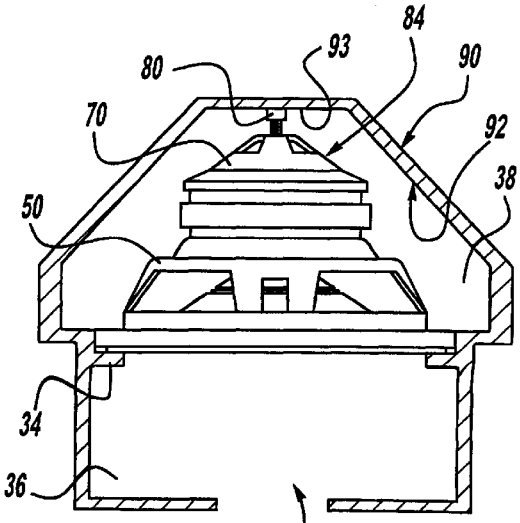
FIG. 11 is a cross-sectional view taken generally along line 11—11 of FIG. 10.

Prior to installing loudspeaker 50 and the mounting apparatus or pressure plate 70 within enclosure 30, the axial force member or bolt 80 is preferably screwed into threaded bore 78 all the way before positioning pressure plate 70 onto the loudspeaker magnet 60. Once performing this procedure, the loudspeaker and mounting apparatus assembly 84 may be inserted into the back volume 38 of enclosure 30. After positioning mounting flange 54 within recess 35, bolt 80 is unscrewed or backed out using a wrench 86 or another suitable tool, such that bolt 80 exerts a force on the back wall or mounting boss 40 as best seen in FIGS. 4 and 11. It should be noted that while the mounting apparatus of the present invention is disclosed in conjunction with second and fourth order enclosures, the concepts of the present invention are also applicable to a variety of enclosures having a fixed speaker mounting plate 34 and fixed mounting boss 40 which are separated by a fixed distance.

As will be appreciated from reviewing the present disclosure, the loudspeaker mounting apparatus of the present invention provides several benefits over the loudspeaker mounting designs known within the art. For example, because all of the axial force generated by bolt 80 is distributed throughout speaker frame 52, there are no localized stress concentrations on gasket 56. This resulting uniform pressure allows for a more reliable and airtight seal between front volume 36 and back volume 38. This uniform pressure also prevents undesirable deformations in frame 52, flange 54 and/or speaker cone 58. The present mounting apparatus also serves to retain magnet 60 in position even if the adhesive bond between frame 52 and magnet 60 should fail. Additionally, the design of the mounting apparatus allows for a variety of enclosure designs in which the loudspeaker installation direction can be perpendicular to the loudspeaker's primary axis, parallel to the primary axis, or alternatively, the loudspeaker may be mounted at an approximately 45° angle (shown in FIG. 4) which eliminates the possibility for water pooling on or about loudspeaker cone 58. Additionally, loudspeaker 50 can easily be removed by rotating bolt 80 such that it retracts into threaded bore 78 which further eliminates the need to remove the entire enclosure 30 from the vehicle body 48. Once assembly 86 is completely installed, enclosure cover or cap 44 may be securely fastened to the rear mounting surface 43 of enclosure 30 with suitable fasteners. While not specifically shown, enclosure cover 44 may also be used as a removable electronics module.

Figure 10:
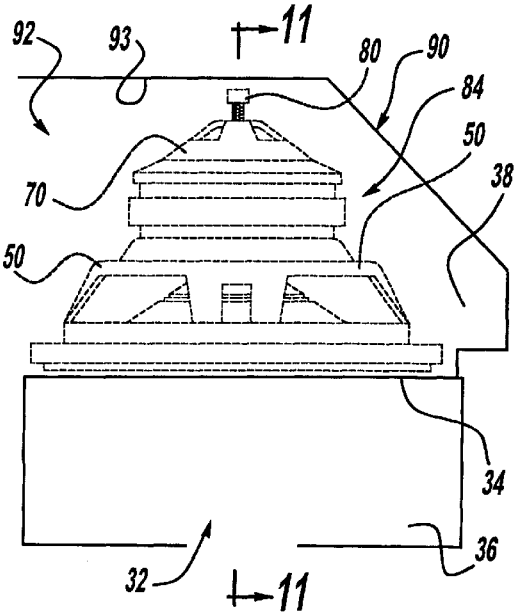
FIG. 10 is a partial sectional view of a loudspeaker enclosure and mounting apparatus in accordance with another preferred embodiment of the present invention.

With reference to FIGS. 10 and 11, an alternate enclosure configuration for accommodating the mounting apparatus of the present invention is shown. More specifically, enclosure 90 is a fourth order enclosure which is substantially similar to enclosure 30 in that a speaker mounting plate 34 defines a front volume 36 and a back volume 38. The primary difference is that loudspeaker 50 is mounted horizontally within enclosure 90. An opening 92 is provided along the side of enclosure 90, thus allowing loudspeaker and mounting apparatus assembly 84 to be inserted therethrough. Again, once properly inserted, bolt 80 can be backed out for engaging back wall 93 for securely retaining assembly 84 within enclosure 90. Once the loudspeaker 50 is properly installed, a suitable cover (not shown) can be installed over opening 92 for sealing back volume 38.

Figure 14:
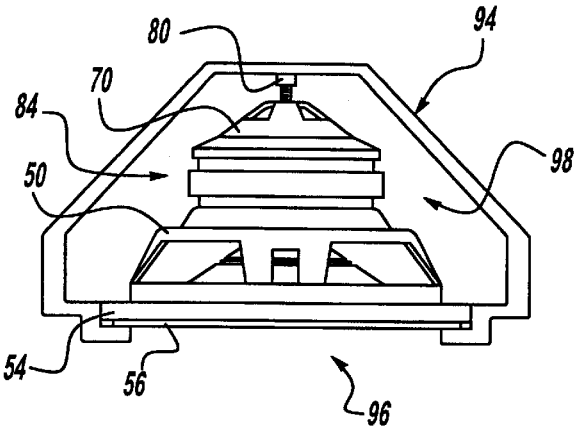
FIG. 14 is a partial sectional view of an alternate loudspeaker enclosure in accordance with the present invention.

As shown in FIG. 14, enclosure 94 is similar in shape to fourth order enclosure 90. Conspicuously absent from enclosure 94 is the front volume chamber and outlet. Accordingly, enclosure 94 is a second order enclosure having an open face 96. However, the loudspeaker and mounting apparatus assembly 84 of the present invention can also be inserted through an opening 98 in enclosure 94 and secured by backing out axial force member 80 as described above. The opening 98 of enclosure 94 can then be covered and sealed in a similar fashion.

Figure 12:
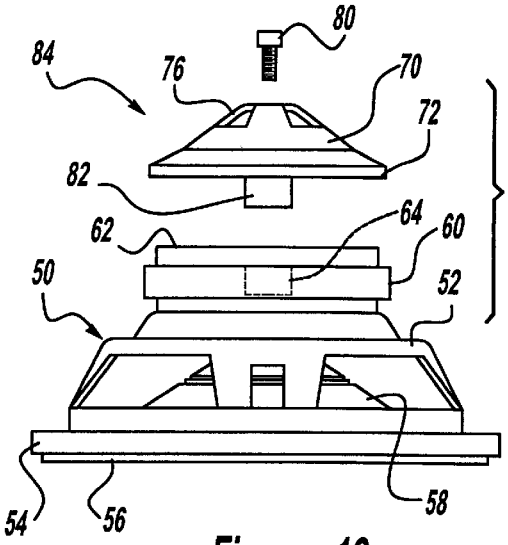
FIG. 12 is an exploded side view of a loudspeaker and mounting apparatus according to an alternate preferred embodiment of the present invention.
Figure 13:
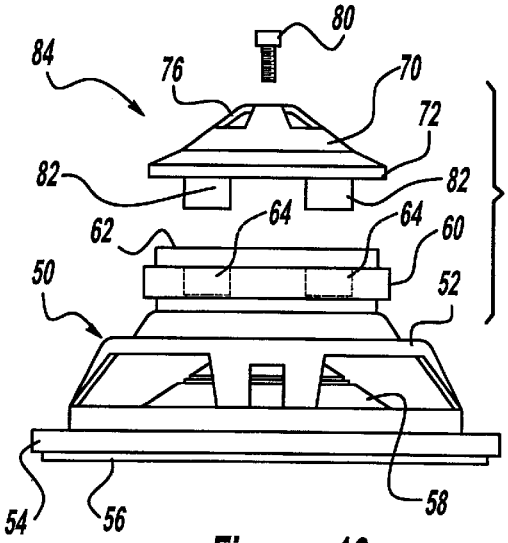
FIG. 13 is an exploded side view of a loudspeaker and mounting apparatus according to another alternative preferred embodiment of the present invention.

Referring now to FIGS. 12 and 13, alternate embodiments of the mounting apparatus 84 according to the present invention are shown. FIG. 12 discloses pressure plate 70 to include a cylindrical heatsink member 82 which extends from the center thereof. Heatsink member 82 is designed to fit within bore 64 of speaker magnet 60. As is known, the portion of the magnet 60 which is closest to the loudspeaker voice coil tends to be warmer than its surrounding structure. Accordingly, heatsink member 82 provides additional contact between the surface area of bore 64 for drawing heat away from magnet 60 and into pressure plate 70 where it can be more readily dissipated. FIG. 13 discloses a variation on this concept wherein pressure plate 70 includes two, or even four, heatsink members 82 which are designed to fit within complimentary bores 64 formed within magnet 60. This embodiment is particularly suitable for applications in which a greater amount of heatsinking and heat dissipation away from magnet 60 is required.

Figure 16:
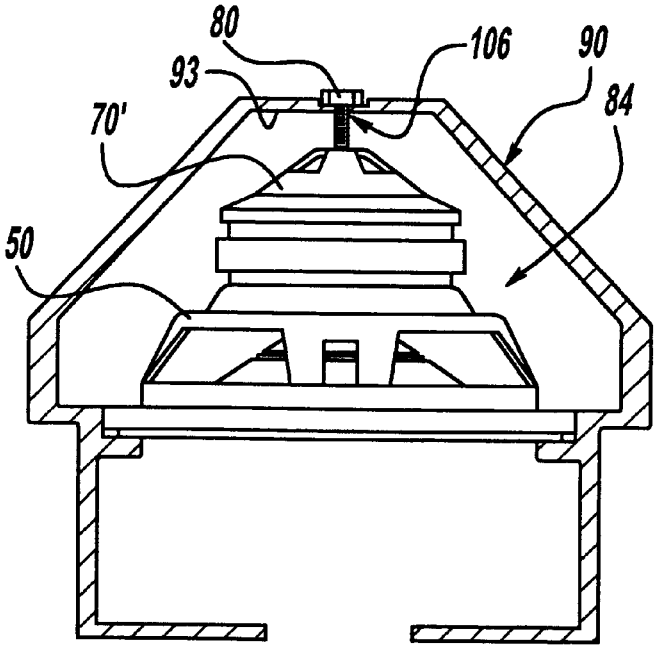
FIG. 16 is a partial sectional view of a loudspeaker enclosure and mounting apparatus in accordance with an alternate preferred embodiment of the present invention.
Figure 17:
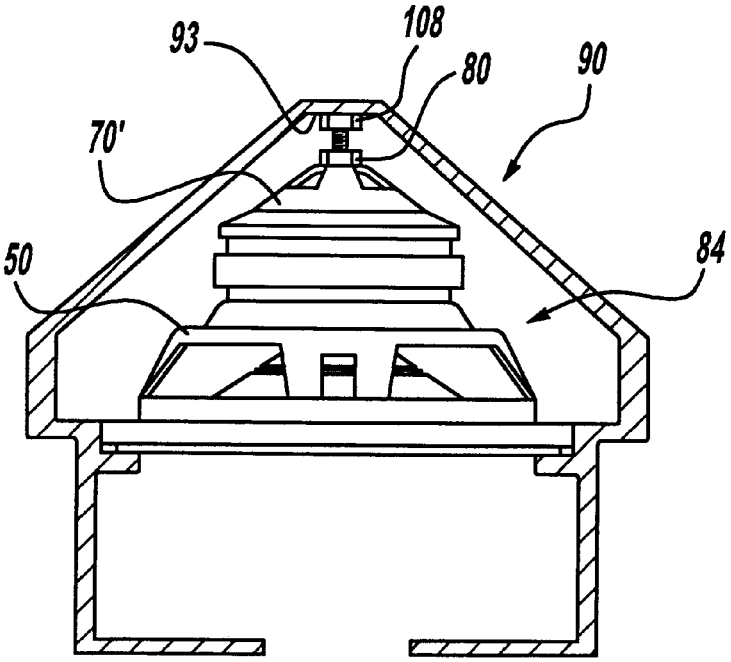
FIG. 17 is a partial sectional view of a loudspeaker enclosure and mounting apparatus also in accordance with an alternate preferred embodiment of the present invention.

With reference to FIGS. 16 and 17, alternate configurations for pressure plate 70 and axial force member 80 are shown within fourth order enclosure 90. As disclosed in this embodiment, pressure plate 70' is similar to pressure plate 70, except that the top of pressure plate 70' does not have a threaded bore formed therein. This modification allows the top of pressure plate 70' to support the force provided by axial force member or threaded bolt 80 which is shown as being threaded through a complimentary threaded bore 106 formed in back wall 93 of enclosure 90. Pressure plate 70' may also include a small recess formed thereon for receiving the end of threaded bolt 80. In this embodiment, mounting apparatus assembly 84 is installed within enclosure 90 and bolt 80 is tightened against pressure plate 70' from the outside of enclosure 90 for securing loudspeaker 50.

FIG. 17 discloses a variation on this concept which utilizes the same pressure plate 70'. However, in this configuration, a nut 108 either engages or is welded to back wall 93. Bolt 80 is screwed up into nut 108 during installation of assembly 84, and the head of bolt 80 is backed out of nut 108 and against pressure plate 70' for securing loudspeaker 50. As yet another alternative configuration (not specifically shown), if the positions of bolt 80 and nut 108 are switched so that the head of bolt 80 engages back wall 93, nut 108 can be used as a lock nut for preventing bolt 80 from turning. This alternate example assumes that pressure plate 70 is employed which includes a threaded bore 78. In this example, bolt 80 would be screwed into bore 78 during installation of assembly 84. Bolt 80 would then be backed out for engaging back wall 93. Once bolt 80 is firmly positioned, nut 108 can be tightened against the top of pressure plate 70 for locking bolt 80 in place.

Figure 15:
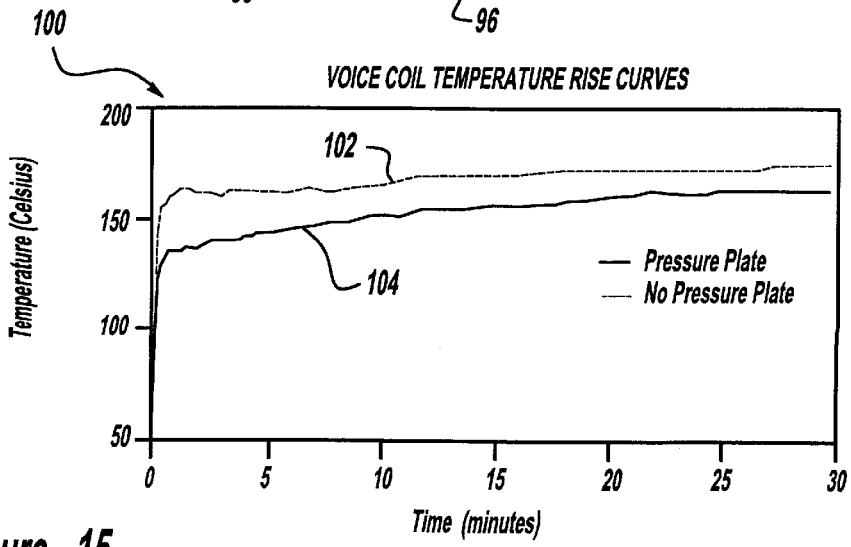
FIG. 15 is a graph showing the reduction in operating temperature achieved through the loudspeaker mounting apparatus of the present invention.

Turning now to FIG. 15, graph 100 illustrates the test data derived by operating an exemplary loudspeaker 50 with no pressure plate, and also with the pressure plate and mounting apparatus of the present invention. In order to quantify the thermal benefits, a comparison test was run on a prototype enclosure with and without pressure plate 70 installed. As part of this test, an enclosure, similar to enclosure 30, was placed inside of a testing oven chamber and heated to 60° C. The temperature of the voice coil and magnet 60 was measured as a function of time using a specially designed measurement circuit. At Time=0, a 10 Vrms sine wave having a frequency of 150 Hz was applied to the loudspeaker 50. As illustrated, temperature curve 102 indicates the operating temperature of loudspeaker 50 with no pressure plate installed. In comparison, temperature curve 104 shows the loudspeaker 50 operating temperature with the pressure plate 70 installed on top of back plate 62. As shown, temperature curve 104 represents an overall lower operating temperature.

After reviewing the resulting test data, it is apparent that the presence of pressure plate 70 provides two distinct benefits. The first benefit of pressure plate 70 is that the voice coil and magnet 60 take a longer period of time to heat up. This benefit dramatically reduces the risk of loudspeaker failure due to momentary bursts of power sent from the system's amplifier. The second benefit is that after a long period of operation, voice coil and magnet 60 operate at an overall cooler temperature. This benefit increases the long term durability of loudspeaker 50.

The foregoing discussion discloses and describes exemplary embodiments of the present invention. One skilled in the art will readily recognize from such discussion, and from the accompanying drawings and claims, that various changes, modifications, and variations can be made therein within departing from the spirit and scope of the invention as defined in the following claims.

What is claimed is:

1. A mounting apparatus comprising:

a first member;

a second member which is separated from the first member by a fixed distance;

a transducer mounted between the first and second members, the transducer including a first surface for engaging the first member and a second surface disposed opposite the first surface;

a pressure operated device disposed between the second surface of the transducer and the second member; and an axial force member associated with the pressure operated device, the axial force member having a threaded portion for threadingly engaging the pressure operated device and an end portion for engaging the second member, wherein the axial force member is operable for applying a compressive force to the pressure operated device and the transducer toward the first member and away from the second member for securing the transducer between the first member and the second member.

2. The mounting apparatus of claim 1 wherein the first member is a loudspeaker mounting plate.

3. The mounting apparatus of claim 2 wherein the loudspeaker mounting plate includes an aperture and an annular recess formed about the aperture.

4. The mounting apparatus of claim 1 wherein the second member is a mounting boss.

5. The mounting apparatus of claim 1 wherein the pressure operated device is a pressure plate.

6. The mounting apparatus of claim 5 wherein the axial force member is a threaded bolt disposed within a threaded bore formed in the pressure plate.

7. The mounting apparatus of claim 2 wherein the transducer is a loudspeaker which is retained against the loudspeaker pressure plate by the pressure operated device and the axial force member.

8. An apparatus for mounting a loudspeaker within an enclosure comprising:

a loudspeaker mounting plate formed within the enclosure;

a mounting boss formed within the enclosure which is separated from the loudspeaker mounting plate by a fixed distance;

the loudspeaker including a first surface for engaging the loudspeaker mounting plate and a second surface disposed opposite the first surface;

a pressure plate disposed between the second surface of the loudspeaker and the mounting boss; and an axial force member extending from the pressure plate, the axial force member having a threaded portion for threadingly engaging the pressure plate and a head portion for engaging the mounting boss, wherein the axial force member can be rotated for forcing the pressure plate and the loudspeaker toward the mounting plate and away from the mounting boss for securing the loudspeaker between the loudspeaker mounting plate and the mounting boss.

9. The apparatus of claim 8 wherein the axial force member is a threaded bolt for engaging a threaded bore formed within the pressure plate.

10. The apparatus of claim 8 wherein a thermally conductive pad is disposed between the pressure plate and the loudspeaker for enhancing the thermal conductivity therebetween.

11. The apparatus of claim 8 wherein the pressure plate includes an annular lip about a circumference thereof for defining a recessed area for receiving the loudspeaker.

12. The apparatus of claim 8 wherein the pressure plate engages a magnet secured to the loudspeaker for drawing heat away from the magnet.

13. The apparatus of claim 8 wherein the pressure plate includes a plurality of vents formed therein for providing an airway to a bore formed in the loudspeaker.

14. The apparatus of claim 8 wherein the pressure plate includes at least one heat sink member extending therefrom for engaging a complimentary bore formed in the loudspeaker.

15. The apparatus of claim 10 wherein the loudspeaker mounting plate, the mounting boss, and the enclosure are formed as a one piece casting.

16. An enclosure for containing a loudspeaker comprising:

a loudspeaker mounting plate defining a loudspeaker opening, the loudspeaker having a first surface for engaging the loudspeaker mounting plate;

a mounting boss formed within the enclosure and disposed at a fixed distance from the loudspeaker mounting plate;

a pressure plate disposed between the loudspeaker and the mounting boss; and an axial force member operably associated with the pressure plate and the enclosure, the axial force member having a threaded portion for threadingly engaging the pressure plate and a head portion for engaging the mounting boss;

the axial force member being disposed between the mounting boss and the pressure plate, wherein the axial force member can be rotated for forcing the pressure plate and the loudspeaker toward the mounting plate and away from the mounting boss for securely mounting the loudspeaker within the enclosure.

17. The enclosure of claim 16 wherein the enclosure is a fourth order enclosure.

18. The enclosure of claim 16 wherein the enclosure is a second order enclosure.

19. The enclosure of claim 16 wherein the axial force member is a threaded bolt for engaging a threaded aperture formed within the pressure plate.

20. The enclosure of claim 19 wherein the threaded bolt may be extended from the pressure plate for engaging the mounting boss and applying a force to the pressure plate for securing the loudspeaker within the enclosure.

21. The enclosure of claim 16 wherein a thermally conductive pad is disposed between the pressure plate and a magnet secured to a rear portion of the loudspeaker.

22. The enclosure of claim 16 wherein the pressure plate is further defined by a conical shape.

23. The enclosure of claim 16 wherein the pressure plate includes an annular lip about a circumference thereof for defining a recessed area for receiving the loudspeaker.

24. The enclosure of claim 16 wherein the pressure plate operates as a heat sink for drawing heat away from a magnet formed on the loudspeaker.

25. The enclosure of claim 16 wherein the pressure plate includes a plurality of vents formed therein for providing an airway to a bore formed in the loudspeaker.

26. The enclosure of claim 16 wherein the pressure plate includes at least one heat sink member extending therefrom for engaging a complimentary aperture formed in a magnet formed on the loudspeaker.

27. The enclosure of claim 16 wherein the loudspeaker includes a mounting flange and the loudspeaker mounting plate includes an annular recess for receiving the mounting flange.

28. The enclosure of claim 27 wherein the a gasket is disposed between the mounting flange and the annular recess.

29. The enclosure of claim 16 wherein the loudspeaker mounting plate is positioned within the enclosure at an approximately 45 degree angle.

30. The enclosure of claim 16 wherein the loudspeaker and the pressure plate may be inserted through an opening formed within a back portion of the enclosure and sealed with a back volume cap.

31. The enclosure of claim 16 wherein the axial force member is a bolt threaded through the enclosure for engaging the pressure plate.

32. The enclosure of claim 16 wherein the axial force member is a nut and bolt assembly disposed between the pressure plate and a back wall of the enclosure.

33. An enclosure for containing a loudspeaker comprising:

a loudspeaker mounting plate defining a loudspeaker opening, the loudspeaker mounting plate having an annular recess formed about the loudspeaker opening, the annular recess receiving the loudspeaker and restraining the loudspeaker from moving with respect to the loudspeaker mounting plate;

a mounting boss formed within the enclosure and disposed at a fixed distance from the loudspeaker mounting plate;

a pressure plate disposed between the loudspeaker and the mounting boss, the pressure plate including an annular lip about a circumference thereof for defining a recess area for receiving the loudspeaker;

a thermally conductive pad disposed between the pressure plate and the loudspeaker for enhancing the thermal conductivity therebetween; and an axial force member extending from the pressure plate, the axial force member having a threaded portion for engaging a threaded aperture formed in the pressure plate, and the axial force member having a head portion for engaging the mounting boss;

the axial force member being disposed between the mounting boss and the pressure plate, wherein the axial force member can be rotated for forcing the pressure plate and the loudspeaker toward the mounting plate and away from the mounting boss for securely mounting the loudspeaker within the enclosure.

* * * * *